United States Patent [19]

Moosmann

[11] Patent Number: 4,694,751

[45] Date of Patent: Sep. 22, 1987

[54] EXPLOSIVE SYSTEM FOR GUIDED MISSILES AND ROCKET PROJECTILES

[75] Inventor: Horst Moosmann, Schramberg, Fed. Rep. of Germany

[73] Assignee: Gebruder Junghans GmbH, Schramberg, Fed. Rep. of Germany

[21] Appl. No.: 797,489

[22] Filed: Nov. 13, 1985

[30] Foreign Application Priority Data

Nov. 13, 1984 [DE] Fed. Rep. of Germany ..... 3441385

[51] Int. Cl.[4] ..... F42C 19/08

[52] U.S. Cl. ..... 102/202; 102/202.14; 102/237; 102/247; 102/499

[58] Field of Search ..... 102/237-247, 102/202, 202.5, 202.14, 317, 318, 322, 380, 352, 364, 275.4, 275.6, 474, 491-496, 499

[56] References Cited

U.S. PATENT DOCUMENTS

| | | | |
|---|---|---|---|
| Re. 25,685 | 11/1964 | Griffith et al. | 102/318 |
| 2,593,775 | 4/1952 | MacLean | 102/249 |
| 3,244,103 | 4/1966 | Spickard | 102/202.5 |
| 3,517,469 | 6/1970 | Brown | 102/473 |
| 4,037,539 | 7/1977 | Hackman | 102/491 |

FOREIGN PATENT DOCUMENTS 2443486 3/1976 Fed. Rep. of Germany .

*Primary Examiner*—Harold J. Tudor

*Attorney, Agent, or Firm*—Burns, Doane, Swecker & Mathis

[57] ABSTRACT

An explosive system for use in projectiles such as guided missiles and rocket projectiles, includes an explosive charge and an ignition booster for igniting the explosive charge. A detonator is provided for igniting the booster. An ignition transfer device is disposed between the detonator and the booster for being ignited by the detonator and igniting the booster. A portion of the ignition transfer device is embedded axially within an end face of the booster.

2 Claims, 2 Drawing Figures

EXPLOSIVE SYSTEM FOR GUIDED MISSILES AND ROCKET PROJECTILES

BACKGROUND AND OBJECTS OF THE INVENTION

The invention relates to an explosive system for guided missiles and rocket projectiles, composed essentially of an explosive charge, a detonator, an ignition transfer device and an ignition booster igniting the explosive charge.

From DE-OS 24 43 486 a warhead fuse for rocket projectiles is known, in which a booster charge 15 is set into an end face of an explosive charge (referenced as "Sprengstoff" in the drawings). The booster charge is ignited by a detonator 12, located at an axial distance from the booster charge. The ignition of the ignition booster thus occurs at a point in the axial end of the booster charge which presents the disadvantage that the detonation wave is propagated only from a point on the axial end or axial side of the ignition booster.

The Oerlikon Taschenbuch (Oerlikon Pocketbook), 2nd Edition, 1981, shows and describes beginning at page 306, rocket percussion fuses with prelauncher safety. Here again, ignition is effected by means of a detonator on an explosive core acting as an ignition transfer device. The ignition is applied axially to the booster charge. Consequently, here again, a point-shaped ignition of the ignition boosters takes place, with the disadvantage that the detonation wave propagates, with hesitation, beginning only at the axial surface. The booster charge thus ignites essentially in an axial manner, with a minimal radial detonation wave.

It is an object of the present invention to provide an ignition system for guided missiles and rocket projectiles of the afore-mentioned type, whereby the effect of the ignition boosters is improved.

SUMMARY OF THE INVENTION

This object is attained according to the invention in that an ignition transfer device is embedded axially within the ignition booster. The ignition transfer device may be provided with a collar whereby it abuts axially against an end face of the ignition booster, while a front part of the ignition transfer device is embedded in the ignition booster. The ignition booster may be inserted in a pot-shaped housing and is surrounded along both axial end surfaces by a tamping material and along its outer circumference by the explosive. The ignition transfer device is embedded axially at one axial end surface. The ignition transfer device may comprise a sleeve with a detonating agent disposed therewithin.

Initiating the detonation of the ignition booster by means of the embedded ignition transfer device substantially improves the radial detonation action of the ignition booster. The effect is further reinforced by the tamping material at both end surfaces of the ignition booster. The detonation wave propagates radially to the circumference of the ignition booster and reaches the outer peripheral surface of the booster essentially simultaneously at all points along such surface. Thus, the detonation occurs uniformly along the axial height of the booster (i.e., a height which is parallel to the axis), which represents an essential improvement over the point initiation of the ignition booster of the prior art.

The simplified configuration of the ignition system according to the invention further makes it possible to provide in a guided missile or a rocket projectile several ignition boosters arranged in succession, with an ignition transfer device embedded in each booster. The boosters would be separated axially from each other by layers of the tamping material and surrounded radially by explosive charges. The ignition of the ignition transfer devices would be effected by individually assigned detonators.

BRIEF DESCRIPTION OF THE DRAWING

An example of the embodiment of the invention is illustrated in the drawing in which.

DETAILED DESCRIPTION OF PREFERRED EMBODIMENTS OF THE INVENTION

Figure 1:
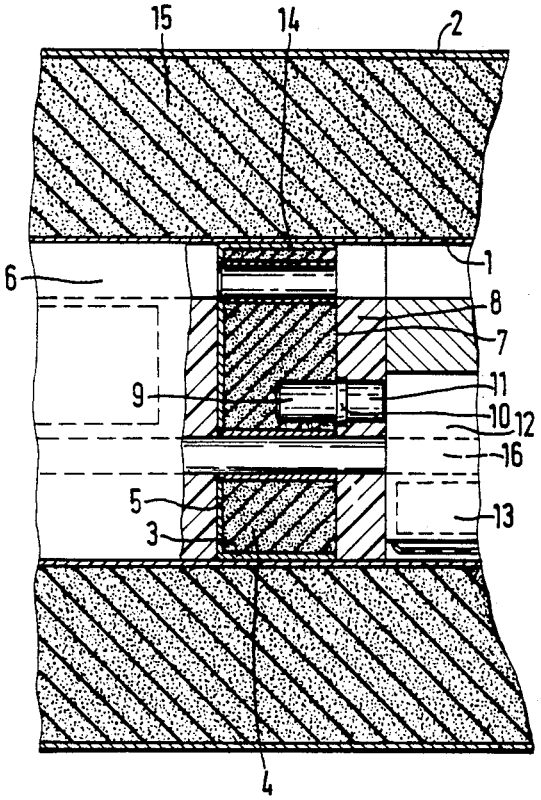
FIG. 1 is a fragmentary longitudinal sectional view through a projectile, depicting an explosive system according to the present invention.

The ignition system according to the invention is located in a cylindrical housing 1, which in turn, is positioned centrally in a casing 2 of a guided missile or a rocket projectile.

A pot-shaped housing 3 disposed in the cylindrical housing 1 contains an ignition booster 4. A layer of a tamping material 4 is placed adjacent to one longitudinally axial end 5 of the ignition booster 6. Another layer of the tamping material 8 is placed axially adjacent to the other axial end surface 7 of the ignition booster 4. An ignition transfer device 9 is inserted centrally into the surface 7 of the ignition booster 4. The transfer device comprises a sleeve having a detonating agent inserted therein, and a collar 10 abutting against the surface 7 of the ignition booster 4. A rear part 11 of the ignition transfer device 9 is inserted through the tamping material 8 and is actively connected at its front side with a detonator support 12. In a firing position of the ignition system, a detonator 13 will have been moved into alignment with the rear part 11. The detonator is mounted on the support which rotates about a shaft 16. An explosive compound 15 is located radially outside the jacket surface 14 of the housing 3.

If the detonator 13 is ignited, which may be effected by conventional electrical or mechanical means, the ignition is transmitted by means of the ignition transfer device 9 to the ignition booster. The detonation wave propagates radially to the circumference of the ignition booster and reaches the peripheral surface of the booster essentially simultaneously at all points along such surface. Thus, the detonation occurs uniformly along the axial height of the booster (i.e., a height which is parallel to the axis) and acts on the explosive charge 15. The simple arrangement and the significantly improved mode of action of this ignition system makes it possible to place a plurality of igniting means in series in the axial direction, as depicted in FIG. 2.

Figure 2:
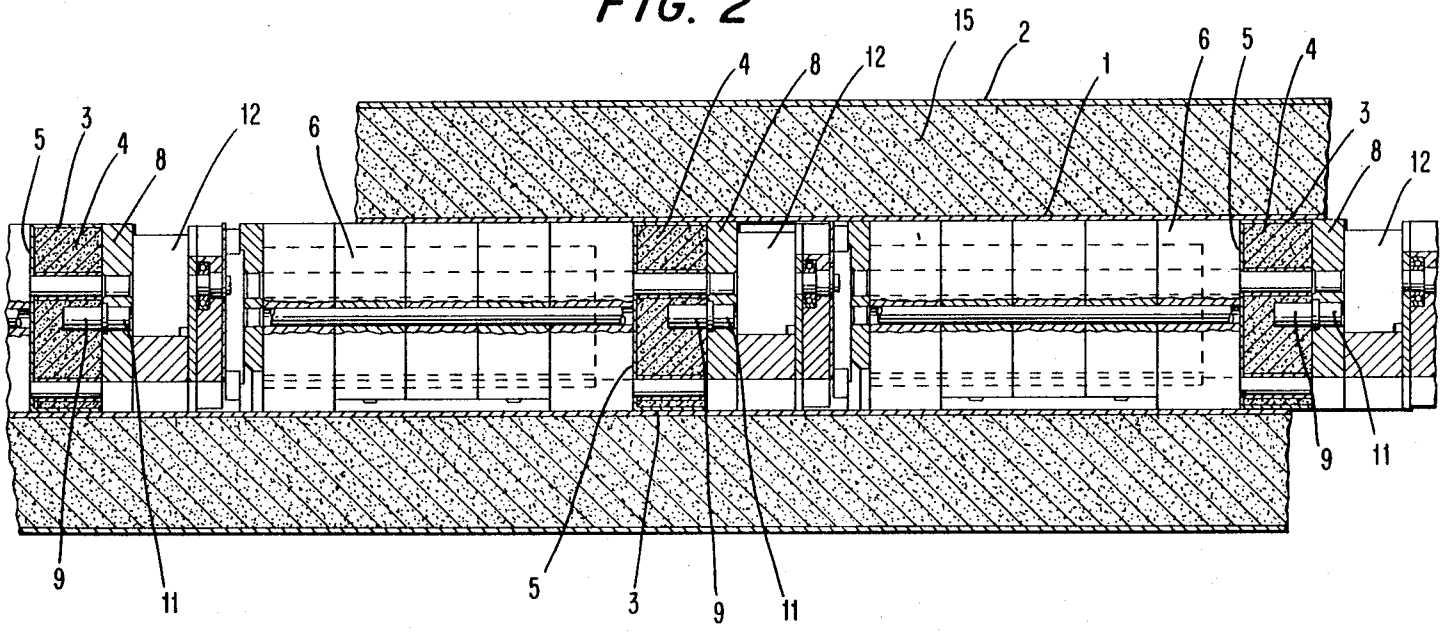
FIG. 2 is a longitudinal sectional view through a modified form of the invention.

Thus, as depicted in FIG. 2, it is possible, for example, to arrange in a cylindrical housing of a guided missile three ignition systems according to the invention spaced apart in the axial direction. Each system would include a booster 4, a detonator 13, and an ignition transfer device 9 embedded in each booster. The boosters would be separated by layers 8 of a tamping material. All of the ignition boosters 4 would thus be equipped in this case with ignition transfer devices 9 embedded in the axial end surface, so that clean circumferential ignition takes place in all of the ignition systems. Ignition would be effected in each case by the individual detonators 13, acting by means of the ignition transfer devices on the ignition boosters. The detonators would be mounted on a common rotor shaft 16.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

What is claimed is:

1. An explosive system for use in projectiles such as guided missiles and rocket projectiles, comprising:

an explosive charge, an ignition booster for igniting said charge, said booster arranged within said charge such that an outer circumference of said booster is encompassed by said explosive charge, said booster defining a longitudinal axis, a detonator spaced longitudinally from said booster for igniting said booster, a layer of material disposed between said booster and said detonator, and an ignition transfer device arranged between said detonator and said booster for being ignited by said detonator and igniting said booster, said ignition transfer device including a first portion embedded longitudinally within said booster, a second portion extending through said layer of material, and an enlarged collar located at a junction of said first and second portions and engaging said booster and said layer of material.

2. An explosive system according to claim 1 comprising a plurality of said boosters arranged in axially spaced relationship, one said detonator provided for each said booster, and one said ignition transfer device arranged between each said detonator and booster and immersed axially within the associated booster, tamping material disposed axially between each booster.

* * * * *